US009227704B2

(12) United States Patent
Ebrahimi

(10) Patent No.: US 9,227,704 B2
(45) Date of Patent: Jan. 5, 2016

(54) SUPPORT SYSTEM FOR A PADDLE BOARD

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 138 days.

(21) Appl. No.: 13/952,463

(22) Filed: Jul. 26, 2013

(65) Prior Publication Data

US 2014/0030942 A1 Jan. 30, 2014

Related U.S. Application Data

(60) Provisional application No. 61/676,110, filed on Jul. 26, 2012.

(51) Int. Cl.
*B63B 35/79* (2006.01)
*B63B 35/85* (2006.01)
*B63B 43/14* (2006.01)

(52) U.S. Cl.
CPC ..... *B63B 35/85* (2013.01); *B63B 35/79* (2013.01); *B63B 35/795* (2013.01); *B63B 43/14* (2013.01)

(58) Field of Classification Search
CPC ..... B63B 35/85; B63B 35/795; B63B 43/14; B63B 35/79
USPC ..... 441/74, 79
See application file for complete search history.

(56) References Cited

U.S. PATENT DOCUMENTS

| | | | | |
|---|---|---|---|---|
| 4,598,659 | A | 7/1986 | Chinnery | |
| 5,711,692 | A * | 1/1998 | Pope | 441/74 |
| 7,082,887 | B2 * | 8/2006 | Fuller | 114/123 |

FOREIGN PATENT DOCUMENTS

| | | | |
|---|---|---|---|
| EP | 0026721 | A1 | 8/1981 |
| JP | 06-298174 | A | 10/1994 |
| WO | WO 9400334 | A1 * | 1/1994 |
| WO | 94-02353 | A | 2/1994 |
| WO | 2012-062973 | A1 | 5/2012 |

OTHER PUBLICATIONS

International Search Report and Written Opinion of Korean Intellectual Property Office Dated Oct. 7, 2013.

* cited by examiner

*Primary Examiner* — Anthony Wiest

(57) ABSTRACT

A support system is configured to increase buoyancy and stability of a paddle board having a central axis running from bow to stern. The support system includes a port side float connected to the paddle board such that the port side float is parallel to the central axis. A starboard side float is connected to the paddle board such that the starboard side float is parallel to the central axis. The port side float and the starboard side float increase lateral stability on the paddle while reducing draft on the paddle board making it safer to float in shallow water.

2 Claims, 10 Drawing Sheets

SUPPORT SYSTEM FOR A PADDLE BOARD

RELATED APPLICATION

This application claims priority to provisional patent application U.S. Ser. No. 61/676,110 filed on Jul. 26, 2012, the entire contents of which is herein incorporated by reference.

BACKGROUND

The embodiments herein relate generally to sports equipment. More specifically, the embodiments herein relate to support systems for paddle boards.

Prior to embodiments of the disclosed invention there was no device that would allow a user to change the shape of a paddle board to increase buoyancy and stability. For instance in U.S. Patent Application Publication 2013/0023169 filed by Morelli, a paddle board is merged with the shape of a tri-hulled catamaran to increase efficiency when used for surfing. Morelli teaches placing additional hulls offset from the paddle board, whereas embodiments of the present invention utilize side floats that lift up and reduce the draft of the paddleboard. Morelli would not really work because the outrigger design would get in the way of a user's paddle.

SUMMARY

A support system is configured to increase buoyancy and stability of a paddle board having a central axis running from bow to stern. The support system includes a port side float connected to the paddle board such that the port side float is parallel to the central axis. A starboard side float is connected to the paddle board such that the starboard side float is parallel to the central axis. The port side float and the starboard side float increase lateral stability on the paddle while reducing draft on the paddle board making it safer to float in shallow water.

In some embodiments, the port side float comprises a port side central channel running with a curvature equal and opposite to a port side portion of the paddle board. The starboard side float comprises a starboard side central channel running with a curvature equal and opposite to a starboard side portion of the paddle board. The paddle board further comprises a first port cavity, a second port cavity, a first starboard cavity and a second starboard cavity. The port side float is mechanically coupled to a first port side pin and a second port side pin. The first port side pin can fit inside the first port cavity and the second port side pin can fit inside the second port cavity. The starboard side float is mechanically coupled to a first starboard side pin and a second starboard side pin. The first starboard side pin can fit inside the first starboard cavity and the second starboard side pin can fit inside the second starboard cavity.

In some embodiments, the paddle board further comprises a port track receiver and a starboard track receiver. The port side float is mechanically coupled to a port track which can fit inside the port track receiver creating a port track system wherein the port track is immediately adjacent to the paddle board while causing the port side float to be parallel to the central axis. The starboard side float is mechanically coupled to a starboard track which can fit inside the starboard track receiver creating a starboard track system wherein the starboard track is immediately adjacent to the paddle board while causing the starboard side float to be parallel to the central axis.

In some embodiments, the port side float comprises a port forward strap channel and a port aft strap channel. The starboard side float comprises a starboard forward strap channel and a starboard aft strap channel. A forward strap threads through the port forward strap channel over and immediately adjacent to the paddle board through the starboard forward strap channel under and beneath the paddle board where the forward strap travels back to the port side float. An aft strap threads through the port aft strap channel over and immediately adjacent to the paddle board, through the starboard aft strap channel under and beneath the paddle board where it travels back to the port side float. The forward strap and the aft strap hold the port side float and the starboard side float immediately adjacent to the paddle board and parallel to the central axis.

In some embodiments, a top sock is mechanically coupled to the port side float and the starboard side float. A bottom sock is mechanically coupled to the port side float and the starboard side float. The top sock and the bottom sock hold the port side float and the starboard side float immediately adjacent to the paddle board and parallel to the central axis.

In some embodiments, port side D-rings and starboard side D-rings are mechanically coupled to the paddle board. Port side float straps are mechanically coupled to the port side float. In this manner, connecting the port side D-rings to the port side float straps render the port side float immediately adjacent to the paddle board and parallel to the central axis. Starboard side float straps are mechanically coupled to the starboard side float. In this manner, connecting the starboard side D-rings to the starboard side float straps renders the starboard side float immediately adjacent to the paddle board and parallel to the central axis.

In some embodiments, port side female buckle receivers and starboard female buckle receivers are mechanically coupled to the paddle board. Port side male buckles are mechanically coupled to the port side float; wherein connecting the port side female buckle receivers to the port side male buckles render the port side float immediately adjacent to the paddle board and parallel to the central axis. Starboard side male buckles are mechanically coupled to the starboard side float. Connecting the starboard side female buckle receivers to the starboard side male buckles renders the starboard side float immediately adjacent to the paddle board and parallel to the central axis.

In some embodiments, the paddle board is covered in a sock wherein the sock further comprises a port track receiver and a starboard track receiver. The port side float is mechanically coupled to a port track which can fit inside the port track receiver creating a port track system wherein the port track is immediately adjacent to the paddle board while causing the port side float to be parallel to the central axis. The starboard side float is mechanically coupled to a starboard track which can fit inside the starboard track receiver creating a starboard track system wherein the starboard track is immediately adjacent to the paddle board while causing the starboard side float to be parallel to the central axis. The sock is mechanically coupled in an air cavity to provide greater comfort for the paddle board while in use.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
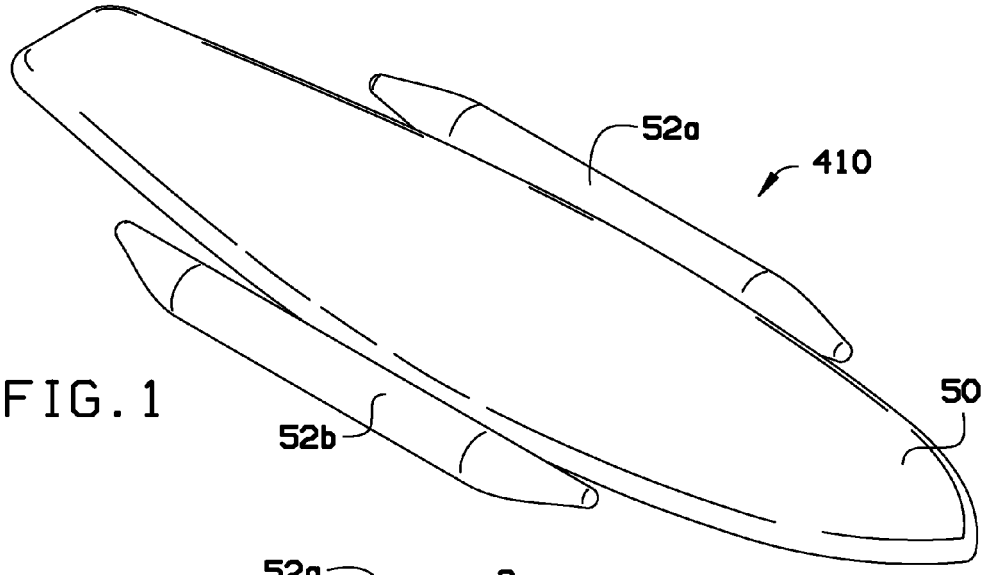
FIG. 1 is a perspective view of a clip-in embodiment.
Figure 2:
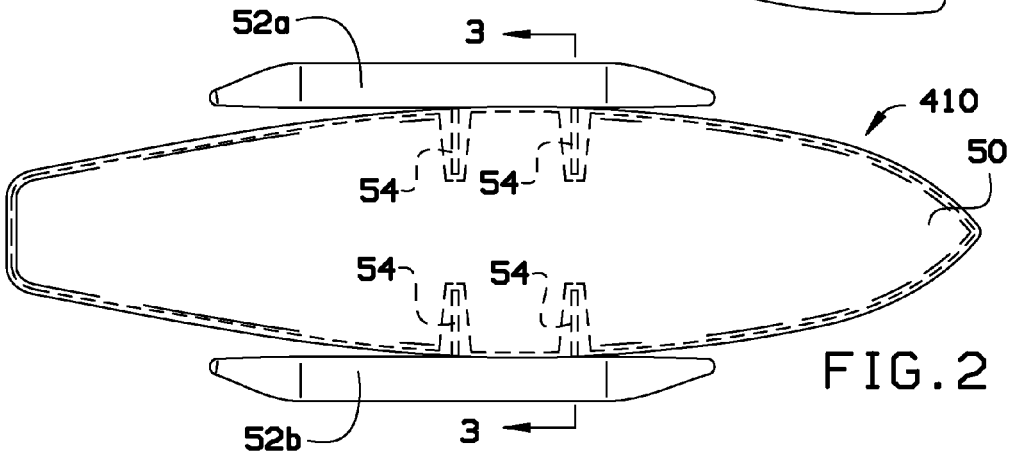
FIG. 2 is a top view of a clip-in embodiment.
Figure 3:
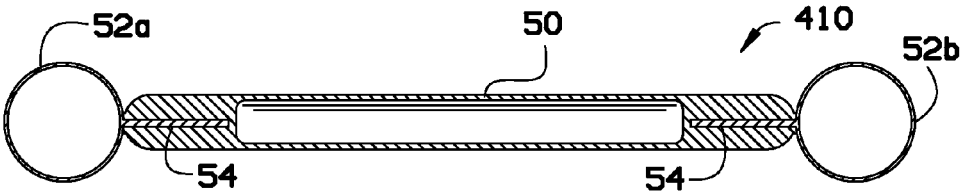
FIG. 3 is a section view of a clip-in embodiment along line 3-3 in FIG. 2.

By way of example, and referring to FIG. 1, FIG. 2 and FIG. 3, paddle board 50 is readily navigable for an experienced user, but it can be difficult to navigate for a novice. Clip-in embodiment 410 provides one solution to this problem. Here, paddle board 50 comprises a central axis from a point at the bow to a midpoint on the stern. Paddle board 50 further comprises two port cavities and two starboard cavities.

Port side float 52A is mechanically coupled to first port pin 54 and second port side pin 54. First port side pin 54 can fit inside a first port cavity on paddle board 50. Likewise, second port side pin 54 can fit inside a second port cavity on paddle board 50. Fitting the port side pins into the port cavities causes port side float 52*a* to be immediately adjacent to paddle board 50 while being parallel to the central axis.

Similarly, starboard side float 52B is mechanically coupled to first starboard pin 54 and second starboard side pin 54. First starboard side pin 54 can fit inside a first starboard cavity on paddle board 50. Likewise, second starboard side pin 54 can fit inside a second starboard cavity on paddle board 50. Fitting the starboard side pins 54 into the starboard cavities causes starboard side float 52B to be immediately adjacent to paddle board 50 while being parallel to the central axis.

Port side float 52A and starboard side float 52B cause additional buoyancy and stability to paddle board 50. This makes paddle board 50 easy to navigate.

Figure 4:
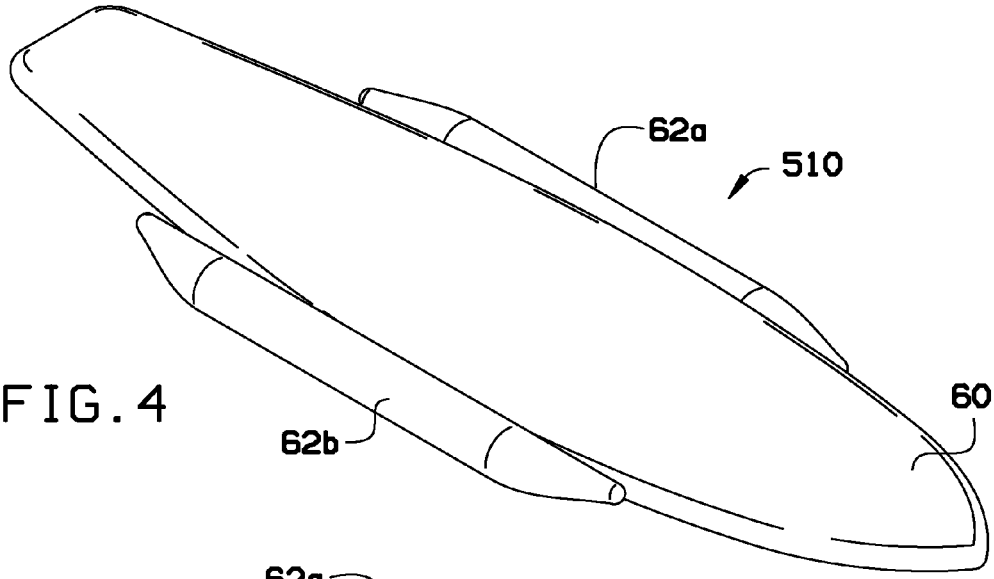
FIG. 4 is a perspective view of an embedded clip-in embodiment.
Figure 5:
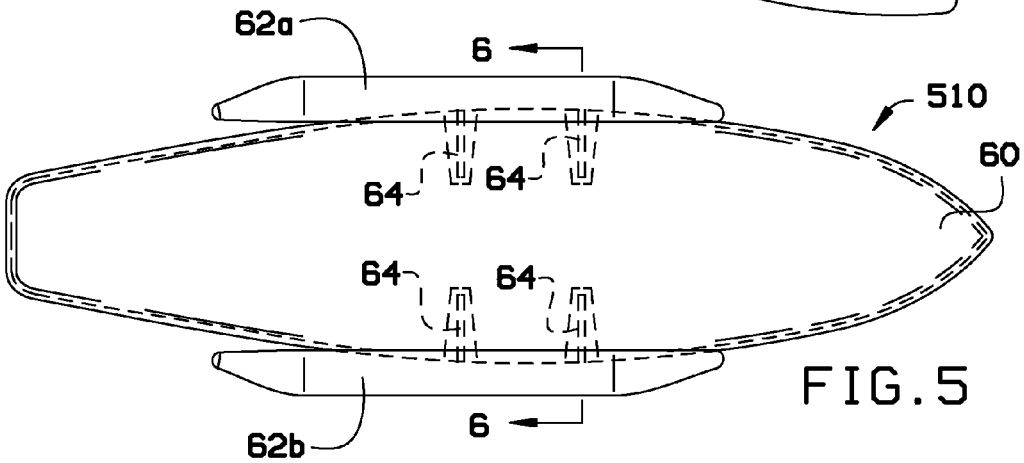
FIG. 5 is a top view of an embedded clip-in embodiment.
Figure 6:
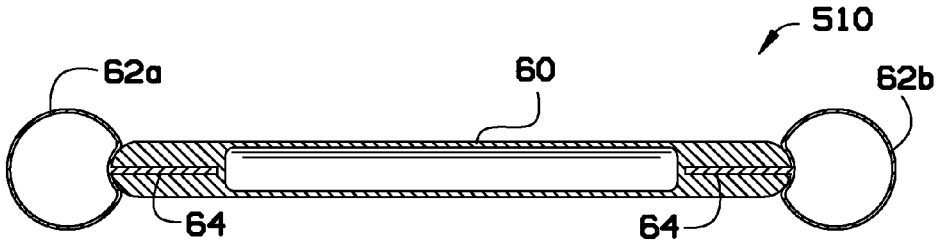
FIG. 6 is a section view of an embedded clip-in embodiment along line 6-6 in FIG. 5.

Turning to FIG. 4, FIG. 5 and FIG. 6, paddle board 60 is readily navigable for an experienced user, but it can be difficult to navigate for a novice. Embedded clip-in embodiment 510 provides one solution to this problem. Here, paddle board 60 comprises a central axis from a point at the bow to a midpoint on the stern. Paddle board 60 further comprises two port cavities and two starboard cavities.

Port side float 62A comprises a port side central channel running from fore to aft with a curvature equal and opposite to a port side portion of paddle board 60. Port side float 62A is mechanically coupled to first port pin 64 and second port side pin 64. First port side pin 64 can fit inside a first port cavity on paddle board 60. Likewise, second port side pin 64 can fit inside a second port cavity on paddle board 60. Fitting the port side pins into the port cavities causes port side float 62A to be immediately adjacent to paddle board 60 while being parallel to the central axis and slightly covering a port portion of paddle board 60.

Similarly, starboard side float 62B comprises a starboard side central channel running from fore to aft with a curvature equal and opposite to a starboard side portion of paddle board 60. Starboard side float 62B is mechanically coupled to first starboard pin 64 and second starboard side pin 64. First starboard side pin 64 can fit inside a first starboard cavity on paddle board 60. Likewise, second starboard side pin 64 can fit inside a second starboard cavity on paddle board 60. Fitting the starboard side pins into the starboard cavities causes starboard side float 62B to be immediately adjacent to paddle board 60 while being parallel to the central axis and slightly covering a starboard portion of paddle board 60.

Port side float 62A and starboard side float 62B cause additional buoyancy and stability to paddle board 60. This makes paddle board 60 easy to navigate. The central channels running from fore to aft with a curvature equal and opposite to a side portion of paddle board 60 provide additional stability when compared to the unchanneled embodiment above.

Figure 7:
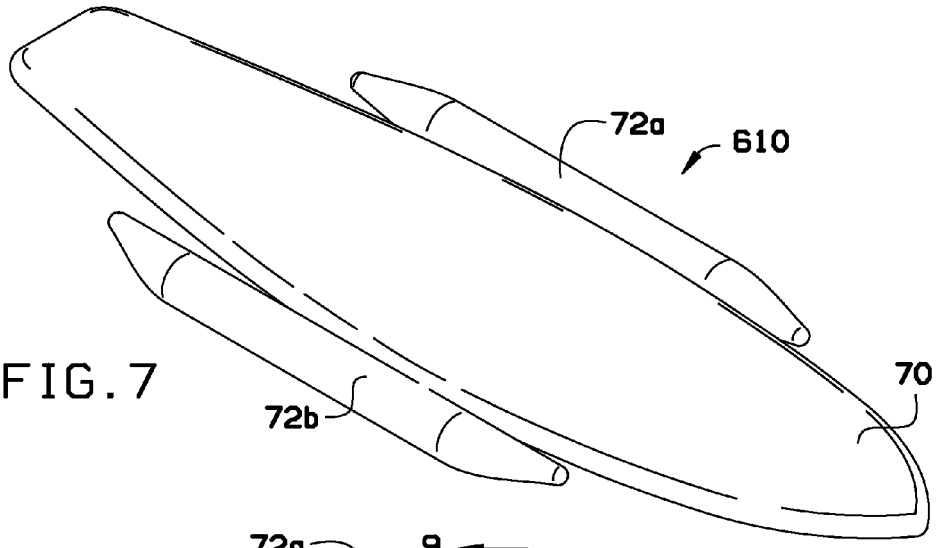
FIG. 7 is a perspective view of a track embodiment.
Figure 8:
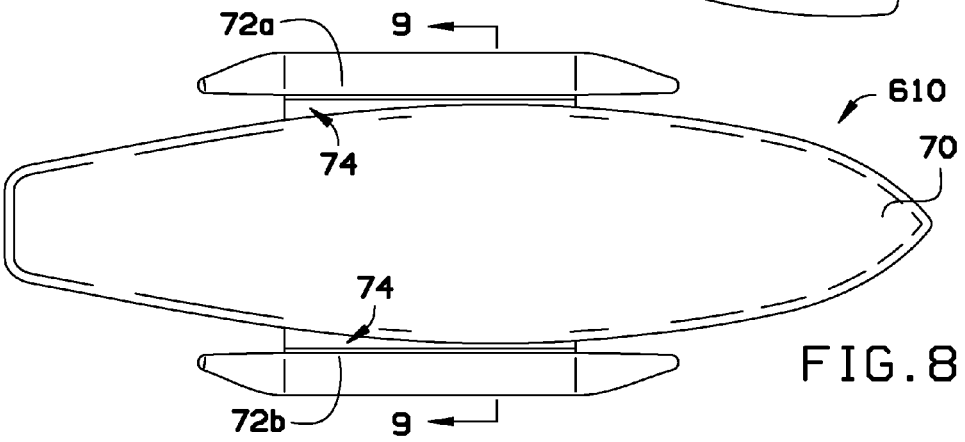
FIG. 8 is a top view of a track embodiment.
Figure 9:
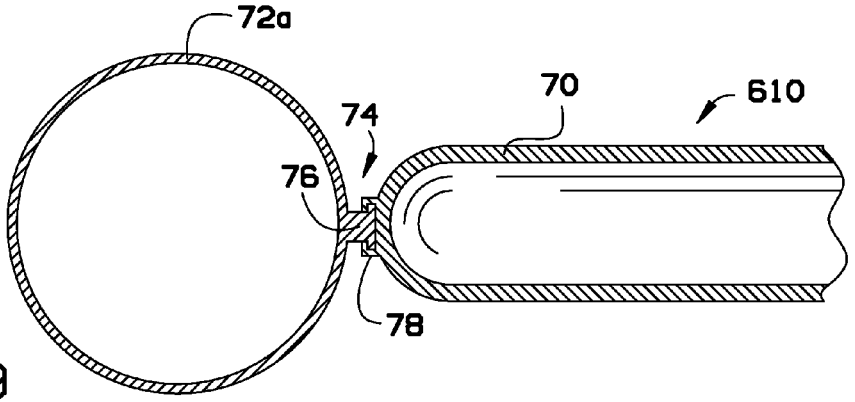
FIG. 9 is a section detail view of a track embodiment along line 9-9*in* FIG. 8.

Turning to FIG. 7, FIG. 8 and FIG. 9, paddle board 70 is readily navigable for an experienced user, but it can be difficult to navigate for a novice. Track embodiment 610 provides one solution to this problem. Here, paddle board 70 comprises a central axis from a point at the bow to a midpoint on the stern. Paddle board 70 further comprises a port track receiver 78 and a starboard track receiver 78.

Port side float 72A is mechanically coupled to port track 76. Port track 76 can fit inside port track receiver 78 creating port track 74. This causes port track 74 to be immediately adjacent to paddle board 70 while causing port side float 72A to be parallel to the central axis.

Similarly, starboard side float 72B is mechanically coupled to starboard track 76. Starboard track 76 can fit inside starboard track receiver 78 creating starboard track 74. This causes starboard track 74 to be immediately adjacent to paddle board 70 while causing starboard side float 72B to be parallel to the central axis.

Port side float 72A and starboard side float 72B cause additional buoyancy and stability to paddle board 70. This makes paddle board 70 easy to navigate. While tracks 74 allow more vertical and horizontal flexibility for side floats 72, they also allow water to flow along a greater surface area slightly reducing efficiency.

Figure 10:
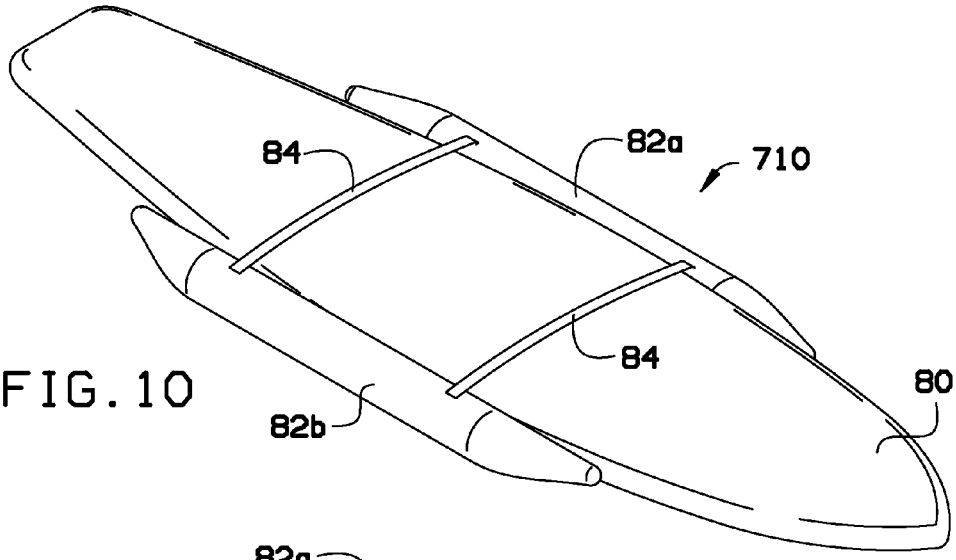
FIG. 10 is a perspective view of a strap embodiment.
Figure 11:
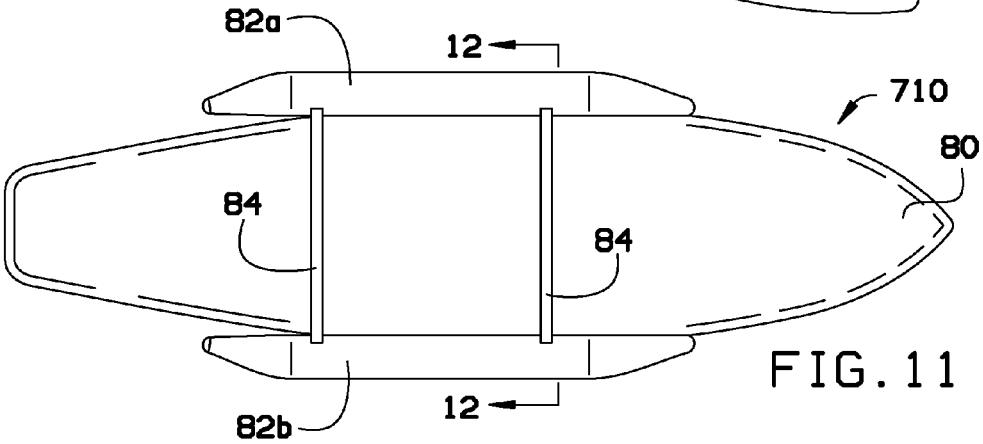
FIG. 11 is a top view of a strap embodiment.
Figure 12:
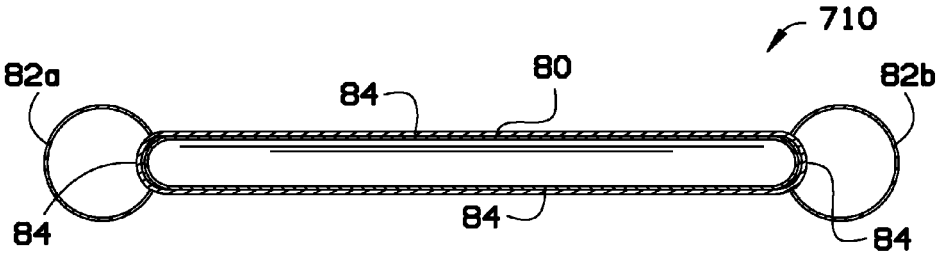
FIG. 12 is a section view of a strap embodiment along line 12-12 in FIG. 11.

Turning to FIG. 10, FIG. 11 and FIG. 12, paddle board 80 is readily navigable for an experienced user, but it can be difficult to navigate for a novice. Strap embodiment 710 provides one solution to this problem. Here, paddle board 80 comprises a central axis from a point at the bow to a midpoint on the stern.

Port side float 82A comprises a port forward strap channel and a port aft strap channel. Likewise, starboard side float 82B comprises a starboard forward strap channel and a starboard aft strap channel. Forward strap 84 threads through the port forward strap channel over and immediately adjacent to paddle board 80, through the starboard forward strap channel under and beneath paddle board 80 where it travels back to port side float 82A. Likewise, aft strap 84 threads through the port aft strap channel over and immediately adjacent to paddle board 80, through the starboard aft strap channel under and beneath paddle board 80 where it travels back to port side float 82A.

This causes paddle board 80 to rest slightly above the center of port side float 82A and starboard side float 82B where port side float 82A and starboard side float 82B are parallel to the central axis. Strap embodiment 710 provides excellent buoyancy and stability paddle board 80, while straps 84 create some turbulence beneath the water and increase drag.

Figure 13:
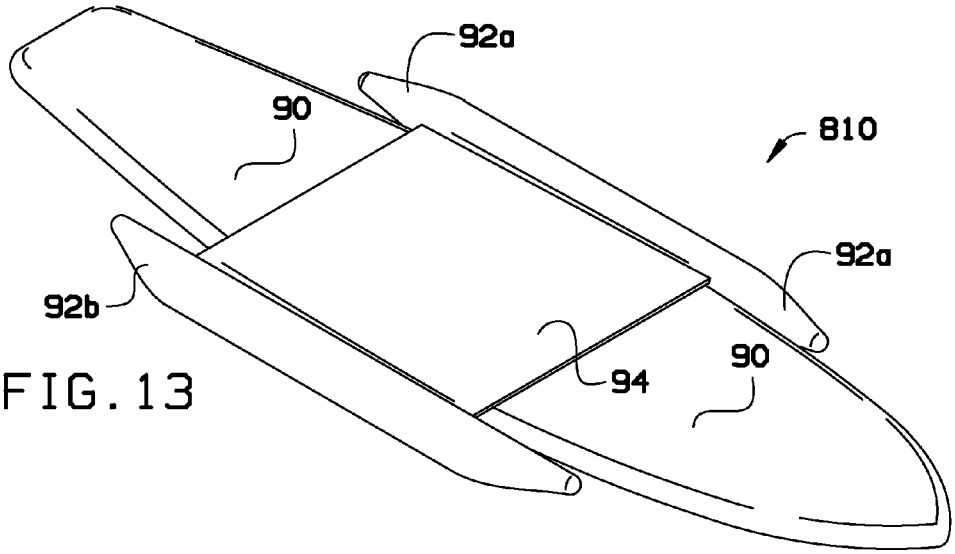
FIG. 13 is a perspective view of a sock embodiment.
Figure 14:
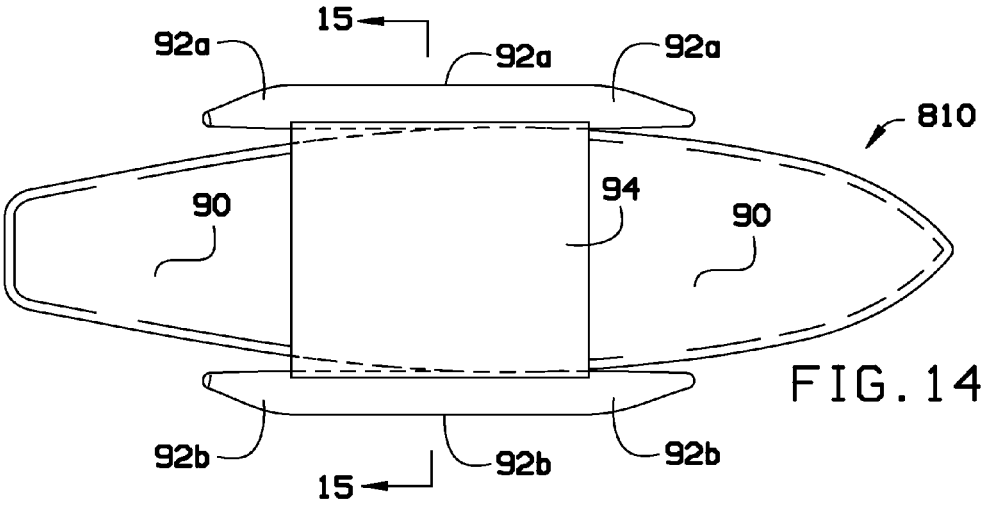
FIG. 14 is a top view of a sock embodiment.
Figure 15:
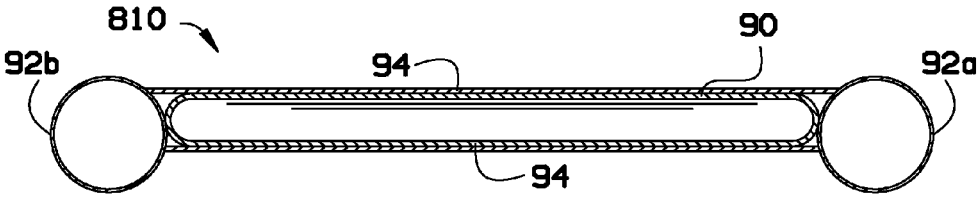
FIG. 15 is a section view of a sock embodiment along line 15-15 in FIG. 14.

Turning to FIG. 13, FIG. 14 and FIG. 15, paddle board 90 is readily navigable for an experienced user, but it can be difficult to navigate for a novice. Sock amidships cover embodiment 810 provides one solution to this problem. Here, paddle board 90 comprises a central axis from a point at the bow to a midpoint on the stern.

Port side float 92A is mechanically coupled to top amidships sock 94. Top amidships sock 94 is further mechanically coupled to starboard side float 92B. Likewise, port side float 92 is mechanically coupled to bottom amidships sock 94. Bottom amidships sock 94 is further mechanically coupled to starboard side float 92B.

A user can install sock amidships cover embodiment 810 onto paddle board 90 by simply sliding sock amidships cover embodiment 810 over paddle board 90. Sock amidships cover embodiment 810 should fit snugly over paddle board 90 to keep drag minimal while providing increased buoyancy and stability for paddle board 90.

Figure 16:
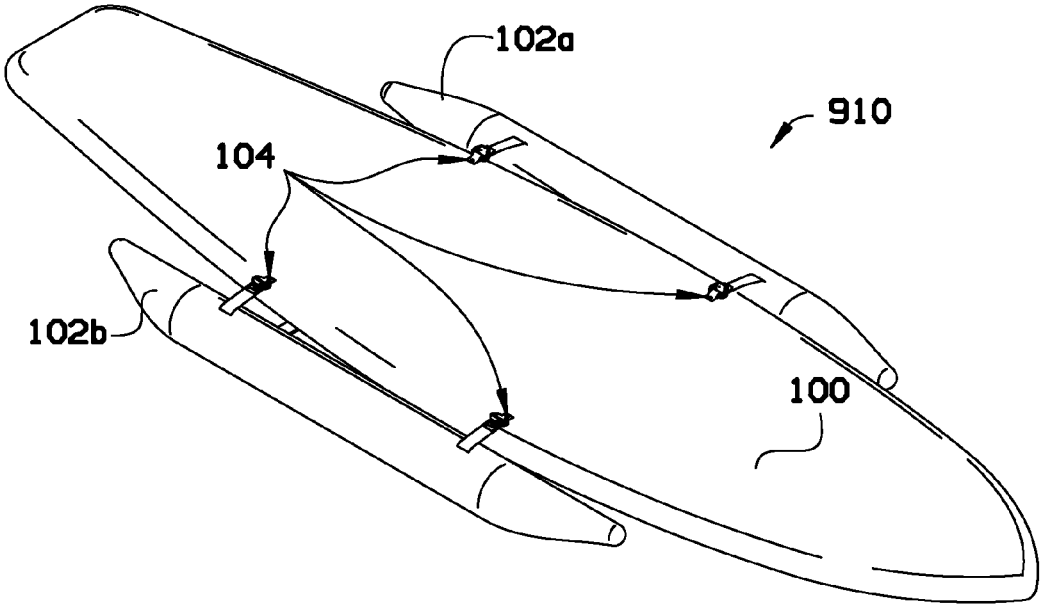
FIG. 16 is a perspective view of a D-ring embodiment.
Figure 17:
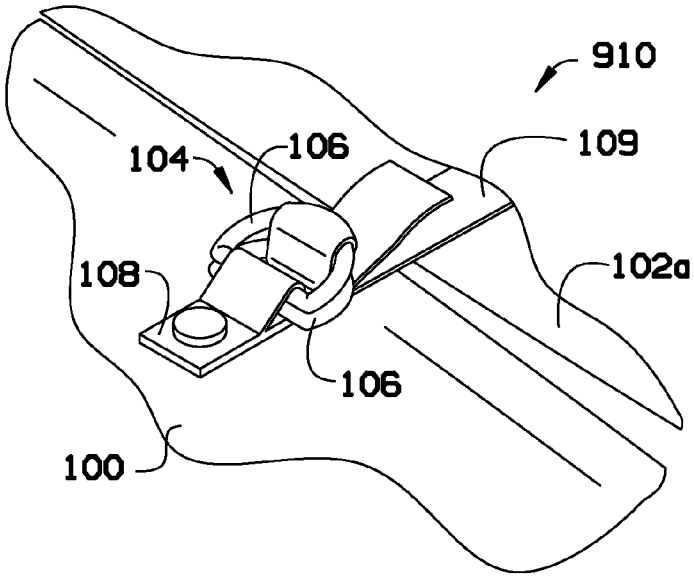
FIG. 17 is a perspective detail view of a D-ring embodiment.

Turning to FIG. 16 and FIG. 17, paddle board 100 is readily navigable for an experienced user, but it can be difficult to navigate for a novice. D-ring embodiment 910 provides one solution to this problem. Here, paddle board 100 comprises a central axis from a point at the bow to a midpoint on the stern.

Paddle board 100 is mechanically coupled to forward port D-ring 106 with forward port paddle board strap 108. Paddle board 100 is further mechanically coupled to aft port D-ring 106 with aft port paddle board strap 108. Port side float 102A is mechanically coupled to forward port side float strap 109 and aft port side float strap 109. A user can attach port side float 102A to paddle board 100 by connecting the D-rings 106 with their respective float straps 109 thereby utilizing d-ring securement system 104.

Likewise, paddle board 100 is mechanically coupled to forward starboard D-ring 106 with forward starboard paddle board strap 108. Paddle board 100 is further mechanically coupled to aft starboard D-ring 106 with aft starboard paddle board strap 108. Starboard side float 102A is mechanically coupled to forward starboard side float strap 109 and aft starboard side float strap 109. A user can attach starboard side float 102A to paddle board 100 by connecting the D-rings 106 with their respective float straps 109 thereby utilizing d-ring securement system 104. Utilizing d-ring securement system 104 holds port side float 102A and starboard side float 102A where both are parallel to the central axis.

Figure 18:
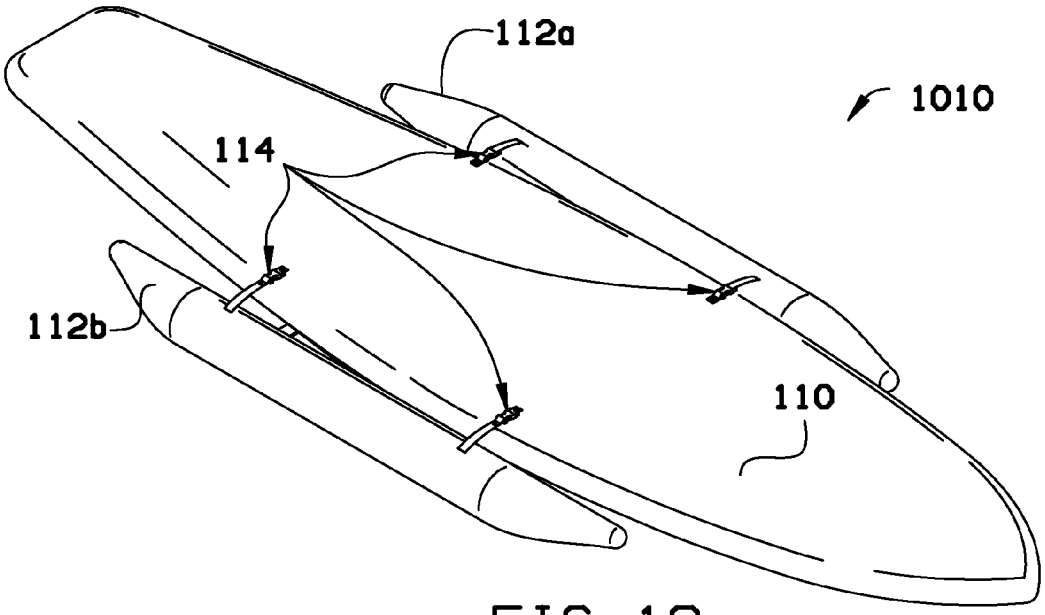
FIG. 18 is a perspective view of a buckle embodiment.
Figure 19:
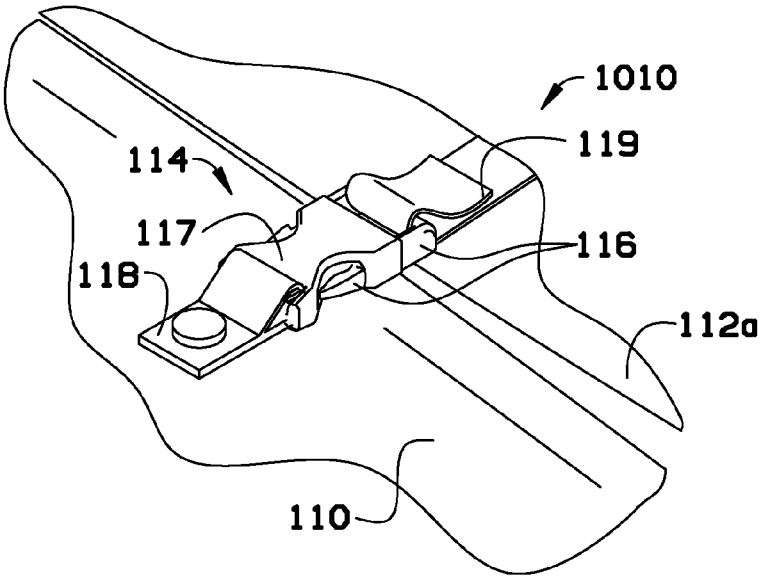
FIG. 19 is a perspective detail view of a buckle embodiment.

Turning to FIG. 18 and FIG. 19, paddle board 110 is readily navigable for an experienced user, but it can be difficult to navigate for a novice. Buckle embodiment 1010 provides one solution to this problem. Here, paddle board 110 comprises a central axis from a point at the bow to a midpoint on the stern.

Paddle board 110 is mechanically coupled to forward port female buckle receiver 117 with forward port paddle board buckle strap 118. Paddle board 100 is further mechanically coupled to aft port female buckle receiver 117 with aft port paddle board buckle strap 118. Port side float 112A is mechanically coupled to male buckle 116 with and aft port side float buckle strap 119. A user can attach port side float 112A to paddle board 110 by connecting male buckles 116 with their respective female buckle receivers 117 thereby utilizing buckle securement system 114.

Likewise, paddle board 110 is mechanically coupled to forward starboard female buckle receiver 117 with forward starboard paddle board buckle strap 118. Paddle board 100 is further mechanically coupled to aft starboard female buckle receiver 117 with aft starboard paddle board buckle strap 118. Starboard side float 112A is mechanically coupled to male buckle 116 with and aft starboard side float buckle strap 119. A user can attach starboard side float 112A to paddle board 110 by connecting male buckles 116 with their respective female buckle receivers 117 thereby utilizing buckle securement system 114. Utilizing buckle securement system 114 holds port side float 112A and starboard side float 112A where both are parallel to the central axis.

Figure 20:
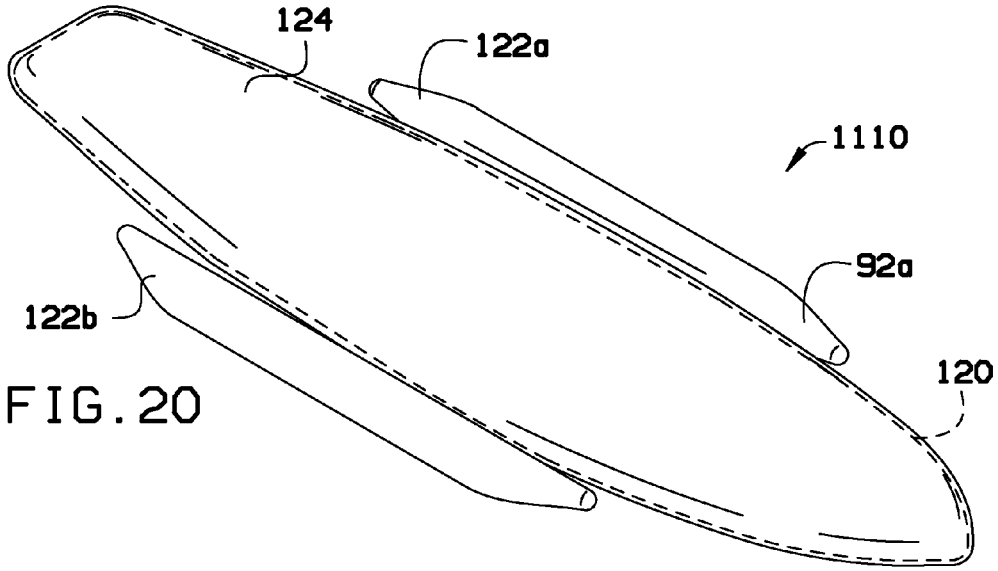
FIG. 20 is a perspective view of a sock-all-cover embodiment.
Figure 21:
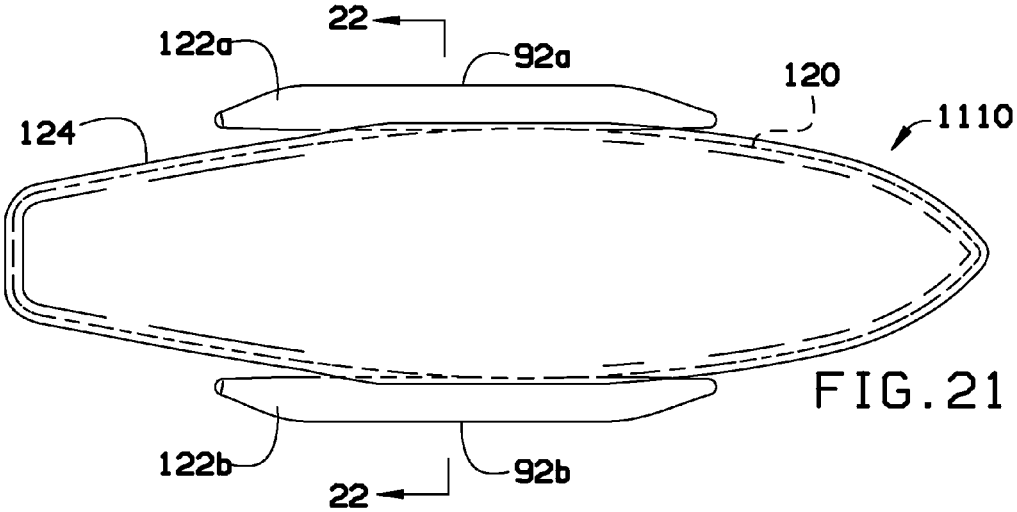
FIG. 21 is a top view of a sock-all-cover embodiment.
Figure 22:
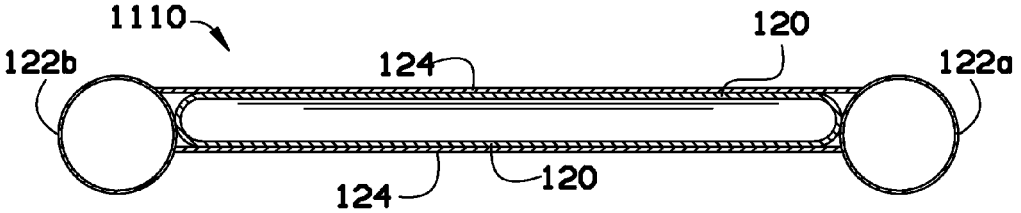
FIG. 22 is a section view of a sock-all-cover embodiment along line 22-22 in FIG. 21.

Turning to FIG. 20, FIG. 21 and FIG. 22, paddle board 120 is readily navigable for an experienced user, but it can be difficult to navigate for a novice. Full length sock cover embodiment 1110 provides one solution to this problem. Here, paddle board 120 comprises a central axis from a point at the bow to a midpoint on the stern. Paddle board 130 is completely covered with full length sock 139.

Port side float 122A is mechanically coupled to top sock 124. Top sock 124 is further mechanically coupled to starboard side float 122B. Likewise, port side float 122A is mechanically coupled to bottom sock 124. Bottom amidships sock 124 is further mechanically coupled to starboard side float 122B. To contrast with sock amidships cover embodiment 810, full length sock cover embodiment 1110 covers the entire length of paddle board 120.

A user can install full length sock cover 1110 onto paddle board 120 by simply sliding full length sock cover 1110 over paddle board 120. Full length sock cover 1110 should fit snugly over paddle board 120 to keep drag minimal while providing increased buoyancy and stability for paddle board 120.

Figure 23:
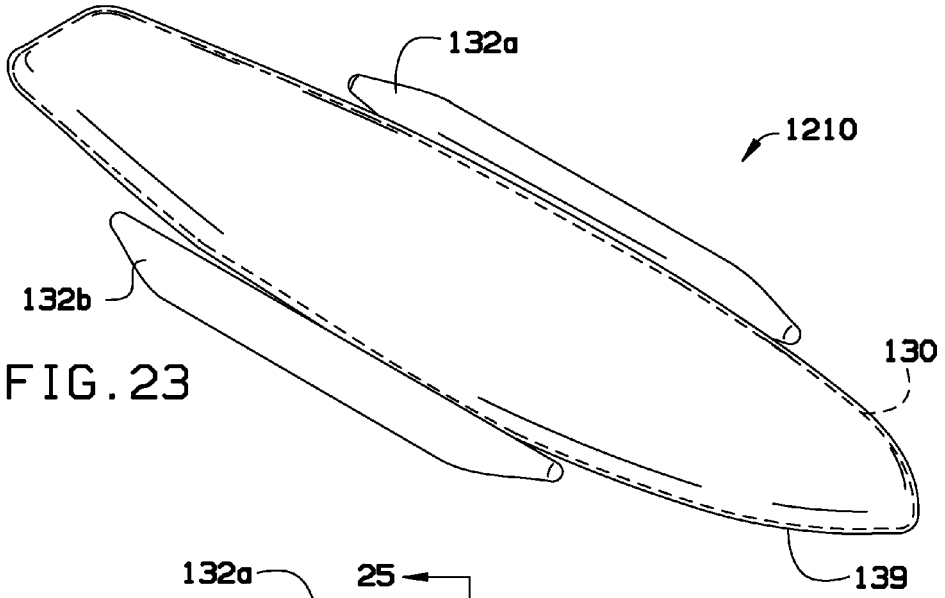
FIG. 23 is a perspective view of a sock and track embodiment.
Figure 24:
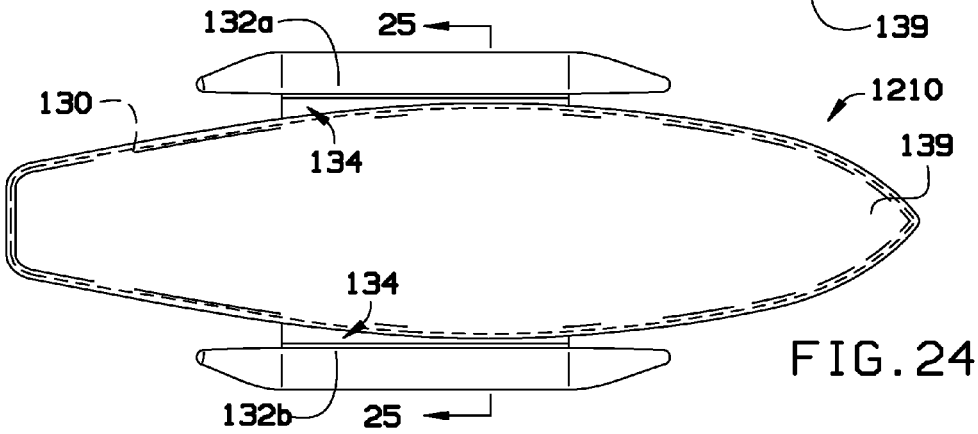
FIG. 24 is a top view of a sock and track embodiment.
Figure 25:
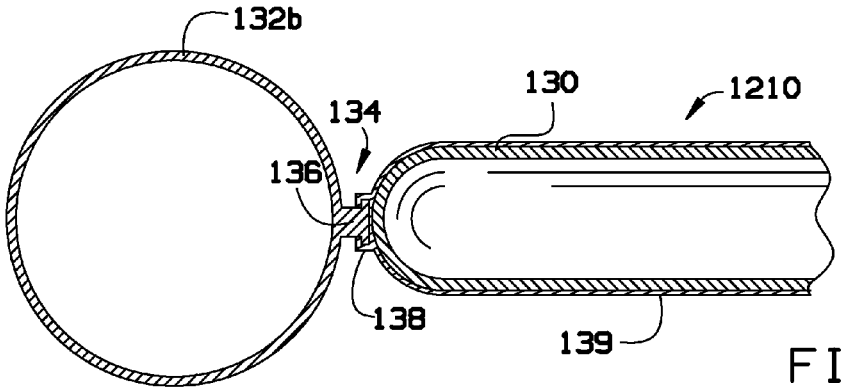
FIG. 25 is a section view of a sock and track embodiment along line 25-25 in FIG. 24.

Turning to FIG. 23, FIG. 24 and FIG. 25, paddle board 130 is readily navigable for an experienced user, but it can be difficult to navigate for a novice. Full length sock cover and track embodiment 1210 provides one solution to this problem. Here, paddle board 130 comprises a central axis from a point at the bow to a midpoint on the stern. Paddle board 130 is covered with sock 139. Sock 139 further comprises a port track receiver 138 and a starboard track receiver 138.

Port side float 132A is mechanically coupled to port track 136. Port track 136 can fit inside port track receiver 138 creating port track 134. This causes port track 134 to be immediately adjacent to paddle board 130 while causing port side float 132A to be parallel to the central axis.

Similarly, starboard side float 132B is mechanically coupled to starboard track 136. Starboard track 136 can fit inside starboard track receiver 138 creating starboard track 134. This causes starboard track 134 to be immediately adjacent to paddle board 130 while causing starboard side float 132B to be parallel to the central axis.

Port side float 132A and starboard side float 132B cause additional buoyancy and stability to paddle board 130. This makes paddle board 130 easy to navigate. While tracks 134 allow more vertical and horizontal flexibility for side floats 132, they also allow water to flow along a greater surface area slightly reducing efficiency.

Figure 26:
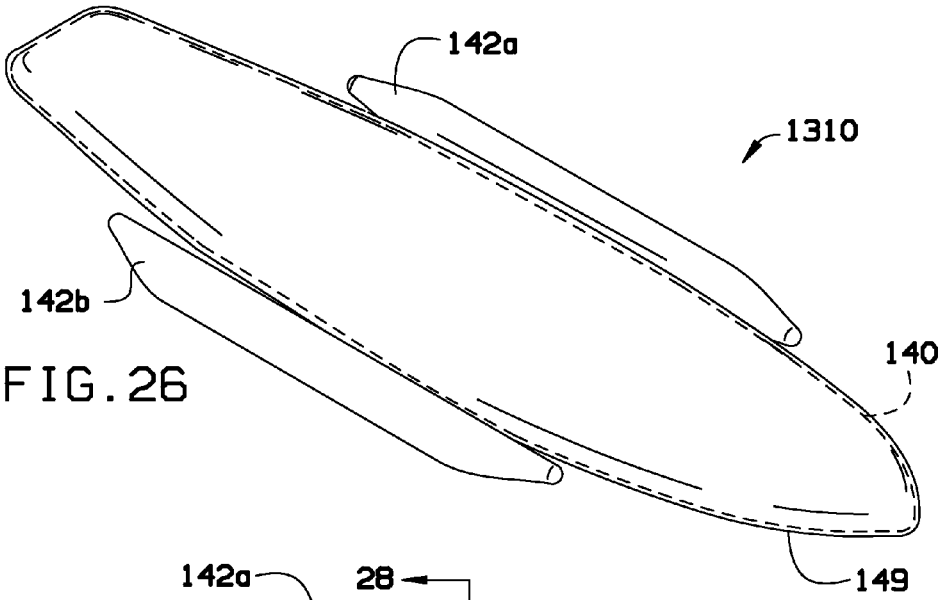
FIG. 26 is a perspective view of a sock and track and air cavity embodiment.
Figure 27:
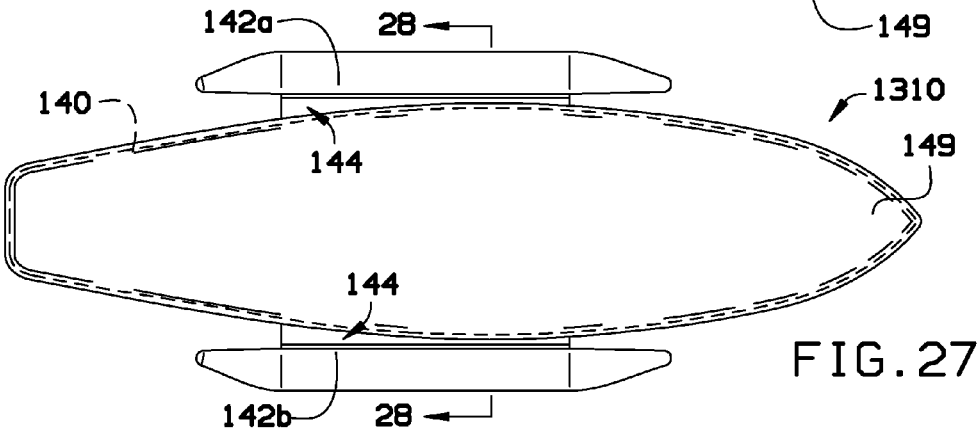
FIG. 27 is a top view of a sock and track and air cavity embodiment.
Figure 28:
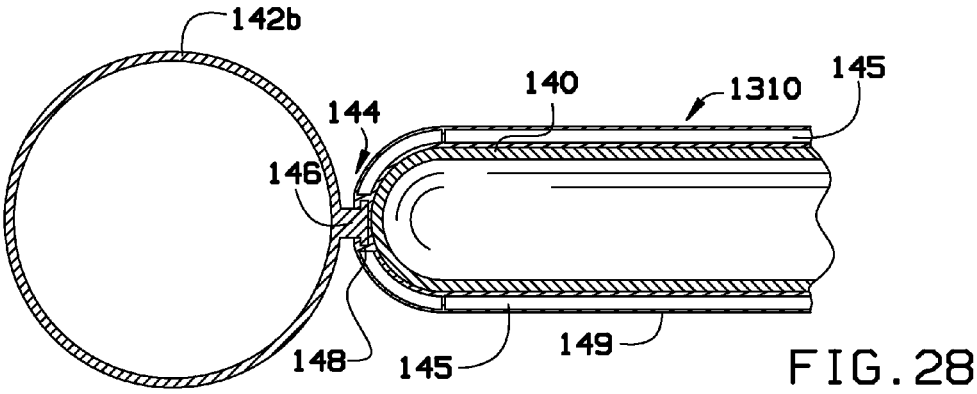
FIG. 28 is a section view of a sock and track and air cavity embodiment along line 28-28 in FIG. 27.

Turning to FIG. 26, FIG. 27 and FIG. 28, paddle board 140 is readily navigable for an experienced user, but it can be difficult to navigate for a novice. Full length sock cover, track and air cavity embodiment 1310 provides one solution to this problem. Here, paddle board 140 comprises a central axis from a point at the bow to a midpoint on the stern. Paddle board 140 is covered with sock 149. Sock 149 is further mechanically coupled to air cavity 145. Air cavity 145 is immediately adjacent to paddle board 140. Sock 149 further comprises a port track receiver 148 and a starboard track receiver 148.

Port side float 142A is mechanically coupled to port track 146. Port track 146 can fit inside port track receiver 148 creating port track 144. This causes port track 144 to be immediately adjacent to paddle board 140 while causing port side float 142A to be parallel to the central axis.

Similarly, starboard side float 142B is mechanically coupled to starboard track 146. Starboard track 146 can fit inside starboard track receiver 148 creating starboard track 144. This causes starboard track 144 to be immediately adjacent to paddle board 140 while causing starboard side float 142B to be parallel to the central axis.

Port side float 142A and starboard side float 142B cause additional buoyancy and stability to paddle board 140. Additionally air cavity 145 can add comfort for a user who would prefer not to stand upon paddle board 140 without a covering. This makes paddle board 140 easy to navigate. While tracks 144 allow more vertical and horizontal flexibility for side floats 142, they also allow water to flow along a greater surface area slightly reducing efficiency.

The port side floats and starboard side floats described above can be made of many known materials in known ways. By way of example, foam, inflatable cavities, plastic, epoxy or carbon fiber would be buoyant and could work.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A support system configured to increase buoyancy and stability of a paddle board having a central axis running from bow to stern, the support system comprising:

a port side float connected to the paddle board midway between the bow and the stern wherein the port side float is parallel to the central axis;

a starboard side float connected to the paddle board midway between the bow and the stern wherein the starboard side float is parallel to the central axis;

wherein the port side float and the starboard side float increase lateral stability on the paddle board while reducing draft on the paddle board making it safer to float in shallow water;

the paddle board further comprises a first port cavity, a second port cavity, a first starboard cavity and a second starboard cavity;

wherein each of the cavities is formed by a slot arranged transverse to the central axis, each slot progressively narrows as the slot extends from an outer periphery of the paddle board inward toward the central axis;

the port side float is mechanically coupled to a first port side cylindrical pin and a second port side cylindrical pin;

wherein the first port side cylindrical pin is adapted to fit inside the first port cavity;

wherein the second port side cylindrical pin is adapted to fit inside the second port cavity;

the starboard side float is mechanically coupled to a first starboard side pin and a second starboard side pin;

wherein the first starboard side cylindrical pin is adapted to fit inside the first starboard cavity; and wherein the second starboard side cylindrical pin is adapted to fit inside the second starboard cavity.

2. The support system of claim 1, the port side float comprises a port side central channel running with a curvature equal and opposite to a port side portion of the paddle board;

the starboard side float comprises a starboard side central channel running with a curvature equal and opposite to a starboard side portion of the paddle board.

* * * * *